United States Patent [19]

Holznagel

[11] 4,275,355

[45] Jun. 23, 1981

[54] DIRECT VIEW STORAGE TUBE HAVING IMPROVED READOUT PERFORMANCE

[75] Inventor: Melvin A. Holznagel, Sherwood, Oreg.

[73] Assignee: Tektronix, Inc., Beaverton, Oreg.

[21] Appl. No.: 14,518

[22] Filed: Feb. 23, 1979

[51] Int. Cl.[3] ..... H01J 29/41

[52] U.S. Cl. ..... 328/124; 315/12 R; 313/396

[58] Field of Search ..... 328/123, 124; 313/396, 313/391; 315/12

[56] References Cited

U.S. PATENT DOCUMENTS

| | | | |
|---|---|---|---|
| 2,927,235 | 3/1960 | Papp | 313/396 |
| 3,753,129 | 8/1973 | Janko | 328/123 |
| 3,862,450 | 1/1975 | Mossman | 313/396 |

*Primary Examiner*—John S. Heyman

[57] ABSTRACT

A flood gun assembly for use in a cathode ray storage tube for uniformly distributing flood electrons over the surface of a storage target includes a mounting member for mounting the flood assembly within the storage tube and on which first flood gun means are mounted. Extensions provided by the mounting member extending toward the corners of the storage target and having second flood gun means mounted thereon.

16 Claims, 2 Drawing Figures

DIRECT VIEW STORAGE TUBE HAVING IMPROVED READOUT PERFORMANCE

BACKGROUND OF THE INVENTION

U.S. Pat. No. 3,426,238 discloses the concept of non-destructively reading out stored information from the storage target of a direct-viewing bistable storage tube wherein the reading electron beam is pulsed as it is raster scanned across the storage target.

Reading out stored and nonstored information that is displayed on the storage target of a direct-viewing bistable storage tube is known by the teaching of U.S. Pat. No. 3,600,509.

Making a permanent or hard copy of information displayed on the storage target of a direct-viewing bistable storage tube is covered in U.S. Pat. No. 3,679,824.

These direct-viewing bistable storage tubes have been made larger so that more information can be stored and visibly displayed on the large storage targets thereof, especially for computer use. Reading out this stored information from these large storage targets in accordance with the teachings of the above-identified patents is necessary in order to make permanent copies of the stored and/or nonstored information.

The electrical readout signals that have been obtained from the corners of the large storage targets have been poor in relation to the readout signals that have been obtained from other areas of the storage targets. It has been found that this is due to the lack of sufficient flood electrons in the corner areas, because, when flood guns were positioned at the corners of the storage target, the amplitude of the readout signals from the unwritten areas in the target coorners was substantially less than the amplitude of the readout signals from the unwritten areas in the target corners when no flood guns were positioned thereat.

SUMMARY OF THE INVENTION

The present invention relates to cathode ray tubes and more particularly to a direct-viewing cathode ray storage tube having improved readout performance.

According to the present invention, a flood gun assembly including flood guns mounted on a rectangular-shaped mounting ring is mounted within the funnel section of a direct-viewing cathode ray storage tube between the storage target and the deflection means which is located at the neck section of the tube. Extensions are provided at the corners of the mounting ring and a flood gun is provided at the outer ends of these extensions to provide flood electrons at the corners of the storage target. The axes of the flood guns on the extensions are directed toward the axis of the tube. The axes of the flood guns mounted within the mounting ring are directed toward the tube axis whereas the axis of the flood guns mounted on the outside of the mounting ring are parallel with the tube axis. The orientation of the flood guns will direct flood electrons over the storage target in a uniform manner, and this results in improved readout signals when the storage target is interrogated by readout pulses as as they are scanned across the target in order to make hard copies of the stored displayed information.

An object of the present invention is to provide a direct-viewing cathode ray storage tube having improved readout performance.

Another object of the present invention is the provision of a direct-viewing cathode ray storage tube that provides improved readout performance for making improved hard copies of the stored displayed information.

A further object of the present invention is to provide a flood gun assembly for use in a cathode ray storage tube which uniformly distributes flood electrons over the entire surface of the storage target.

An additional object of the present invention is the provision of a flood gun assembly for use in a cathode ray storage tube wherein the axes of the flood guns are oriented relative to the axis of the tube to uniformly distribute flood electrons over the entire surface of the storage target.

BRIEF DESCRIPTION OF THE DRAWING

The foregoing and other objects and advantages of the invention will become apparent from the following description and accompanying drawing which by way of example illustrates a preferred embodiment of the invention. It is to be understood however that the description and drawing are not intended as a limitation of the invention.

DETAILED DESCRIPTION OF THE INVENTION

Figure 1:
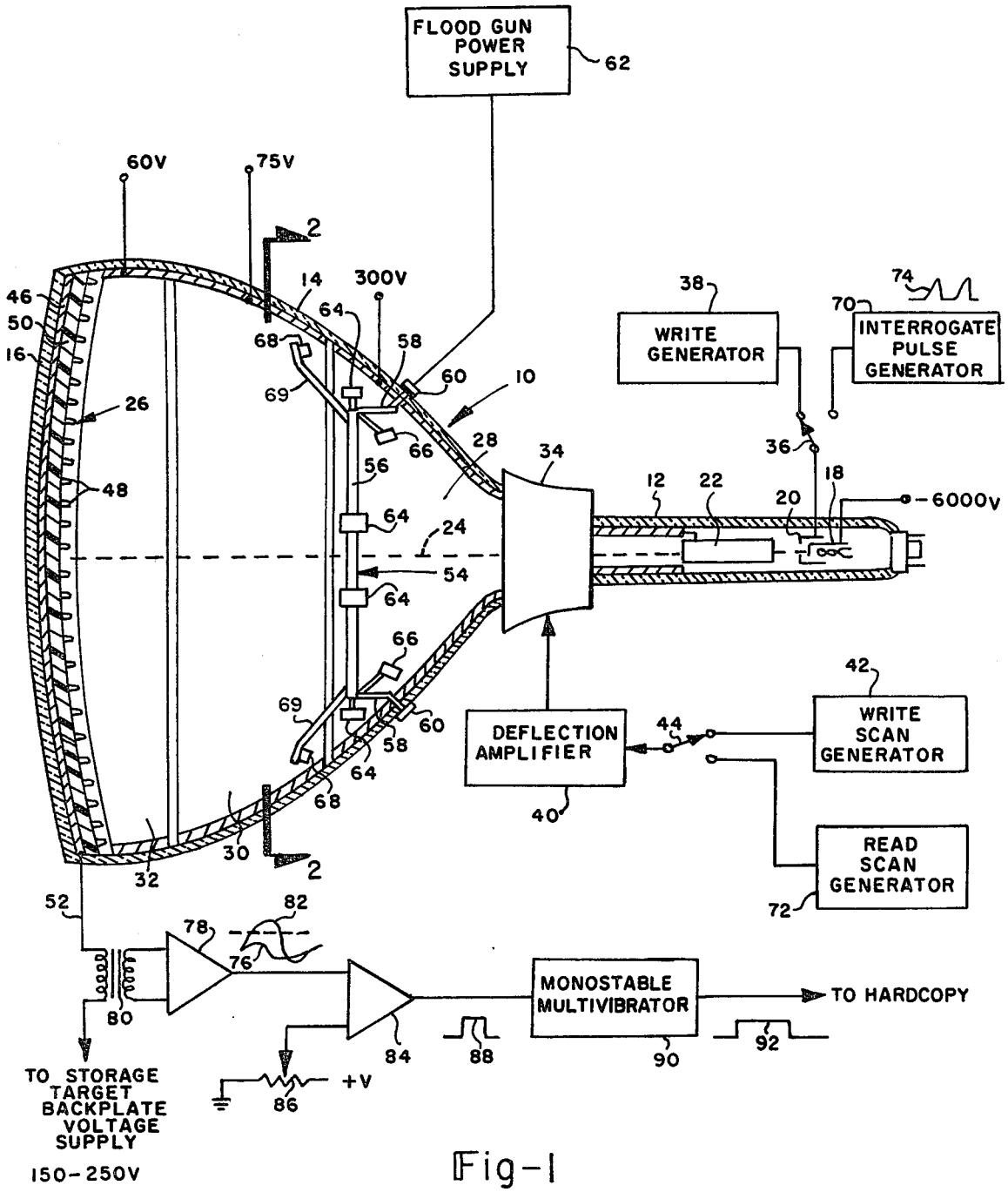
FIG. 1 is a longitudinal cross-sectional view of a cathode ray storage tube incorporating the flood gun assembly.
Figure 2:
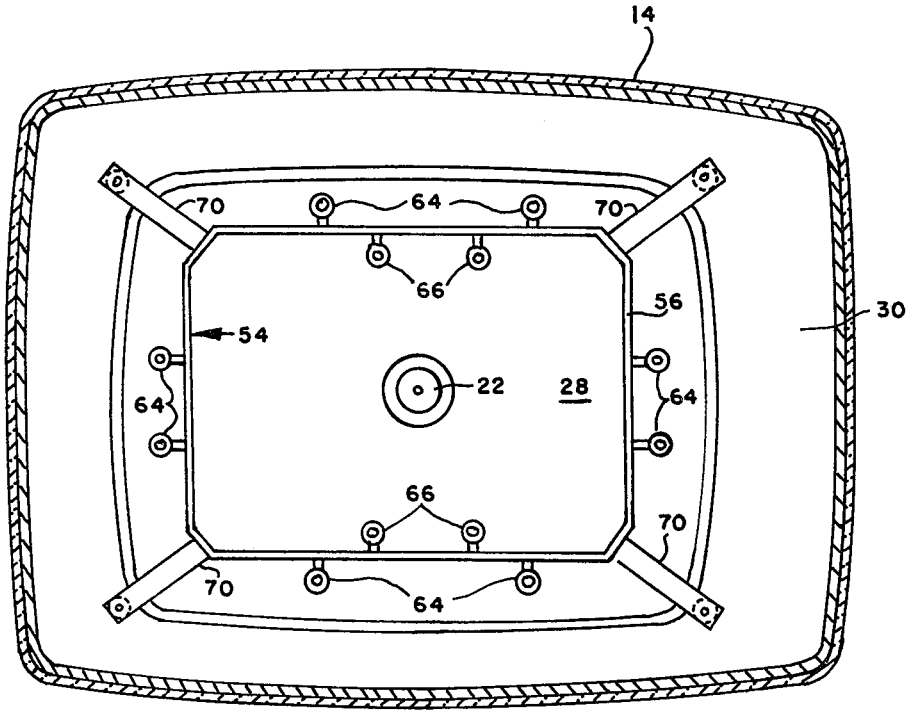
FIG. 2 is a view taken along the line 2—2 of FIG. 1.

A cathode ray storage tube 10 includes a neck section 12, a funnel section 14 and a faceplace section 16. A heated cathode 18 is located in neck section 12 along with grid 20 and focussing and accelerating lens 22 and these elements generate, focus and accelerate electron beam 24 toward storage target 26 on the inside surface of the faceplate of faceplate section 16 which is dish-shaped and frit sealed to funnel section 14. Cathode 18 is connected to −6000 volts and lens 22 is connected to 300 volts through a conductive coating 28 that is located on part of the inside surface of neck section 12 and funnel section 14. Collimating electrodes 30 and 32 in the form of conductive coatings are located on the inside surface of funnel section 14 and facepate section 16 respectively and collimating electrode 30 is connected to 75 volts while collimating electrode 32 is connected to 60 volts. A magnetic deflection yoke 34 is mounted at the juncture of neck section 12 and funnel section 14.

Grid 20 is connected via switch 36 to write generator 38 which applies the signal voltage to grid 20 for writing information in the form of charge patterns via electron beam 24 on storage target 26. Deflection amplifier 40 is connected to deflection yoke 34 and write scan generator 42 supplies signal voltages to deflection amplifier 40 via switch 44 in order to direct electron beam 24 to selected locations along target 26 in order to write information thereon.

Storage target 26 can be the type of target that is disclosed in U.S. Pat. No. 3,956,662, and it includes a transparent conductive coating 46 adhered to the inside surface of faceplate 16, a dot array of conductive collector electrode members 48 that have their inner ends electrically connected to conductive coating 46 and a layer of bistable storage phosphor material 50 located on conductive coating 46 with collector electrode members 48 extending through storage phosphor layer 50 with the outer ends of collector electrode members 48 being exposed. Storage target 26 can also be any other suitable form of bistable storage target. Conductive coating 46 is connected to a storage target backplate voltage supply of 150–250 volts via lead 52 and collector electrode members 48 are also at this voltage.

After information has been written on storage target 26 as charge images, a flood gun assembly 54 supplies flood electrons to target 26 and flood electrons are attracted to the charge images, and they cause target 26 to be driven towards one of two stable potentials while the charge images give off secondary electrons which are collected by collector electrode members 48 to retain the charge images in a stored mode for viewing or for read out purposes.

Flood gun assembly 54 includes a metal rectangular-shaped mounting ring 56 which is mounted in position within funnel section 14 via mounting members 58 which are secured to plugs 60 located within funnel section 14. Plugs 60 have connected thereto flood gun power supply 62 which supplies anode, cathode and heater voltages to flood guns 64 that are mounted on the exterior of mounting ring 56, flood guns 66 that are mounted within mounting ring 56 and flood gun 68, each of which is mounted to the free end of extensions 69 which have their inner ends secured at the corners of mounting ring 56.

The axes of flood guns 64 are parallel with the tube axis. The axes of flood guns 66 can be from 10° to 25° relative to the longitudinal tube axis and the axes of flood guns 68 can be from 0° to 15° relative to the tube axis. Flood guns 64, 66 and 68 are in parallel planes normal to the longitudinal tube axis. As a result of the angular orientation of the axes of the flood guns and positioning flood guns 68 at the corners of storage target 26, flood electrons from the flood guns will be substantially uniformly distributed over the storage target which results in improved readout signals for producing improved hard copies of the stored information. Collimating electrodes 30 and 32 generate fields to influence the uniform distribution of the flood electrons over storage target 26, and flood gun assembly 54 is mounted just before the collimating electrodes 30 and 32 so that they have maximum influence on flood electron coverage over the storage target 26.

When readout of the stored information is desired, switches 36 and 44 are switched respectively to interrogate pulse generator 70 and read scan generator 72. Switches 36 and 44 can be ganged together. Interrogate pulse generator 70 produces a series of short duration voltage pulses 74 which are applied to grid 20 thereby generating pulses of the electron beam 24 which are scanned across storage target 26 under the control of read scan generator 72 signals that are impressed onto deflection yoke 34 via switch 44 and deflection amplifier 40. Pulses 74 are of such duration and rate that pulsation of electron beam 24 will impinge on target 26 at sequencially scanned or selected locations such that information is read out from conductive coating 46 nondestructively, i.e. information is not read onto target 26 nor taken therefrom by action of the pulsed interrogating beam.

During operation, when electron beam 24 strikes an unwritten area of target 26, and output signal 76 appears at the output of amplifier 78 after it is transmitted to amplifier 78 via lead 52 and transformer 80 whereas output signal 82 appears at the output of amplifier 78 which is representative of beam 24 striking a written area of target 26.

The output of amplifier 78 is coupled to one input of voltage comparator 84 which has another input from potentiometer 86 which sets the voltage level above which voltage comparator 84 produces a square wave output signal 88 representative of such input signal. The threshold voltage, which is represented as a broken line between signals 76 and 82, is ideally set via potentiometer 86 which is above the maximum height of a readout signal 76 obtained from an unwritten area and below the minimum height of an output signal 82 obtained from a written area. In practice, the threshold is set at a point at which background noise and dropout of written information on the finished hardcopy are both negligible.

The output signal 88 of voltage comparator 84 drives monostable multivibrator 90 which produces an output pulse 92 of uniform width to operate the hardcopy unit (not shown) in the same manner as disclosed in U.S. Pat. No. 3,679,824. The circuits of write generator 38, deflection amplifier 40, write scan generator 42, interrogate pulse generator 70, read scan generator 72, amplifier 78, voltage comparator 84 and monostable multivibrator 90 are of conventional design.

It has been found that if flood electrons are not substantially uniformly distributed over the surface of storage target 26 and especially in the corners of a rectangular target, the readout signals 76 obtained from unwritten areas of the storage target would approach the amplitude of the readout signals 82 obtained from written areas. In this way, the readout signals from the unwritten areas in the corners would frequently be slightly over the threshold level and they would be processed through voltage comparator 84 as signals from written areas thereby resulting in poor hardcopies. By placing flood guns 68 at the corners of target 26 and orienting the axes of flood guns 64, 66 and 68 relative to the tube axis, flood electrons are uniformly distributed over target 26 thereby resulting in readout signals 76 being of substantially less amplitude and hardcopies being of substantially improved quality.

Although magnetic deflection has been disclosed, electrostatic deflection can also be used. With uniform distribution of flood electrons over target 26, the pulsed interrogating reading electron beam does not have to be held to strict amplitude and time. The flood gun assembly effectively distributes flood electrons substantially uniformly over the storage target surface to generate readout signals representative of the stored written information at any position on the storage target and the unwritten areas do not generate readout signals that would show up on the hardcopies thereby resulting in greatly improved hardcopies of the stored information. Conductive coating 46 is preferably transparent to enable direct viewing of the displayed information, but it can be nontransparent resulting in nonviewing and scan conversion operation only.

While a preferred embodiment of the invention has been shown and described, it will be apparent to those skilled in the art that many changes and modifications may be made without departing from the invention in its broader aspects. The appended claims therefore cover all such changes and modifications as fall within the true spirit and scope of the invention.

The invention is claimed in acordance with the following:

1. A cathode ray storage tube comprising:

an envelope having a neck section, a funnel section and a faceplate section of generally polygonal configuration;

storage target means provided on an inside surface of said faceplate section;

electron gun means provided within said neck section for generating, focussing and accelerating an electron beam toward and onto said storage target;

write generator means connected to said electron gun means for controlling said electron beam;

deflection means for deflecting said electron beam over said storage target to form charge images thereon; and a flood gun assembly within said funnel section between said deflection means and said target means, said assembly including mounting means having first flood gun means mounted along said mounting means, extensions provided by said mounting means extending toward corners of said storage target and second flood gun means mounted on said extensions, said flood gun means generating and distributing flood electrons substantially uniformly over said storage target with some of said flood electrons being attracted to said charge images to drive the areas containing said charge images towards one of two stable potentials for the purpose of storing said charge images as stored information.

2. A cathode ray storage tube according to claim 1 wherein some of said first flood gun means have their axes disposed at an angle relative to a longitudinal axis of said tube and others of said first flood gun means have their axes substantially parallel to said tube axis.

3. A cathode ray storage tube according to claim 2 wherein the angle of some of said first flood gun means varies from 10° to 25° relative to said longitudinal axis.

4. A cathode ray storage tube according to claim 1 wherein said second flood gun means have their axes disposed at an angle relative to a longitudinal axis of said tube.

5. A cathode ray storage tube according to claim 4 wherein the angle varies from 0° to 15° relative to said longitudinal axis.

6. A cathode ray storage tube according to claim 1 wherein said first flood gun means and said second flood gun means are disposed in parallel planes normal to a longitudinal axis of said tube.

7. A cathode ray storage tube according to claim 6 wherein said first flood gun means define first flood guns located in the same plane as said mounting means and second flood guns located in one of said parallel planes.

8. A cathode ray storage tube according to claim 1 further including readout means comprising interrogation generator means connected to said electron gun means for pulsing said electron beam during readout at a duration less than that necessary to change unwritten areas from one stable potential to another, readout circuit means connected to said storage target for detecting readout signals from written and unwritten areas of said storage target, and means to process signals from said written areas and reject signals from said unwritten areas.

9. A cathode ray storage tube according to claim 1 wherein said faceplate is transparent and a conductive coating forming part of said storage target is transparent to enable direct viewing of the stored information.

10. A flood gun assembly for a cathode ray storage tube having a polygonal faceplate section, said assembly providing substantially uniform distribution of flood electrons over a storage target within said faceplate section, comprising:

a support frame;

means for mounting said frame within a cathode ray storage tube;

a first plurality of flood guns supported by said frame adjacent the periphery thereof, and a second plurality of flood guns mounted on extensions secured to said frame and extending toward the corners of the faceplate section when mounted within said tube.

11. A flood gun assembly according to claim 10 wherein said first plurality of flood guns includes a first group of flood guns oriented to dispose their axes substantially parallel to the longitudinal axis of the storage tube in which said asembly is mounted, and a second group of flood guns oriented to dispose their axes at an oblique angle relative to said longitudinal axis.

12. A flood gun assembly according to claim 11 wherein the flood guns of said second group are disposed at angles of about 10° to about 25° relative to said longitudinal axis.

13. A flood gun assembly according to claim 11 wherein the flood guns of said first and said second groups are located in parallel planes normal to said longitudinal axis.

14. A flood gun assembly according to claim 11 wherein the flood guns of said second plurality, said first group and said second group are located in parallel planes normal to said longitudinal axis.

15. A flood gun assembly according to claim 10 wherein the flood guns of said second plurality are oreinted to dispose their axes at an oblique angle relative to the longitudinal axis of the storage tube in which said assembly is mounted.

16. A flood gun assembly according to claim 15 wherein the flood guns of said second plurality are disposed at angles of about 1° to about 15° relative to said longitudinal axis.

* * * * *

UNITED STATES PATENT AND TRADEMARK OFFICE

CERTIFICATE OF CORRECTION

PATENT NO. : 4,275,355

DATED : June 23, 1981

INVENTOR(S) : Melvin A. Holznagel

It is certified that error appears in the above-identified patent and that said Letters Patent are hereby corrected as shown below:

Col. 1, line 34 reads "coorners" should be --corners--.

Col. 6, line 47 reads "oreinted" should be --oriented--.

Signed and Sealed this

*First* Day of *September 1981*

[SEAL]

*Attest:*

GERALD J. MOSSINGHOFF

*Attesting Officer*

*Commissioner of Patents and Trademarks*